United States Patent [19]

Prusman

[11] Patent Number: 4,710,149

[45] Date of Patent: Dec. 1, 1987

[54] TOY VEHICLE WITH SELF-CONTAINED BRIDGE

[76] Inventor: David Prusman, 138 Walgrove Ave., Dobbs Ferry, N.Y. 10522

[21] Appl. No.: 842,306

[22] Filed: Mar. 21, 1986

[51] Int. Cl.[4] ..... A47H 18/00

[52] U.S. Cl. ..... 446/476; 446/425; 446/433

[58] Field of Search ..... 446/424, 425, 426, 433, 446/434, 476, 454; 14/2.4

[56] References Cited

U.S. PATENT DOCUMENTS 3,427,746 2/1969 Jacobs ..... 446/433
3,941,391 1/1970 Soffge ..... 14/2.4

FOREIGN PATENT DOCUMENTS 859277 6/1940 France ..... 14/2.4

*Primary Examiner*—Joseph Falk

*Attorney, Agent, or Firm*—Schweitzer & Cornman

[57] ABSTRACT

A remote controlled toy vehicle carrying a self-contained bridge. When the toy vehicle approaches a road hazard, for example, a water hazard, the vehicle is stopped and the bridge, carried by the toy vehicle, is caused to be flipped over the vehicle from its vehicle trailing position, the position for transporting vehicle and bridge, to a position in front of the toy vehicle, the position for use of the bridge by the vehicle. Then, the toy vehicle is allowed to cross the bridge and the road hazard. The movement of the toy vehicle up and over the bridge causes the bridge to automatically return to its vehicle trailing position and the vehicle and bridge are again able to be moved about, as desired. In the preferred embodiment, the self-contained bridge is attached to the toy vehicle by a pair of telescopic support tubes. A remote controlled motor causes the support tubes, pivotably supporting the bridge, to flip over the vehicle, as desired.

11 Claims, 7 Drawing Figures

TOY VEHICLE WITH SELF-CONTAINED BRIDGE

BACKGROUND OF THE INVENTION

The present invention relates to toy vehicles and, specifically, remote controlled toy vehicles, preferably in the form of an army truck. The present invention provides a self-contained, i.e., constantly attached bridge for a remove controlled toy vehicle which bridge is capable of spanning a hazard in the path of the vehicle when the bridge is selectively moved from a first vehicle trailing position, where is it located during movement of the vehicle, to a second position in front of the vehicle. The vehicle, after the bridge is placed in its operative or hazard spanning position is then capable of passing over the bridge and, yet, the bridge remains attached to the toy vehicle. The motion of the vehicle passing over the attached bridge causes the bridge to automatically change from the hazard spanning position, i.e., the bridge located in front of the vehicle, to the transport mode of the vehicle and bridge, i.e., the bridge trailing behind the vehicle. Then, the vehicle, along with the attached bridge, can be driven, as desired, to another location for redeployment.

Toys with wheels and, specifically, toy vehicles are especially attractive to youngsters. These young children play with the toy vehicles and pretend that the toy vehicles travel on roads, highways, tough terrain, etc. The toy vehicles when played with frequently encounter road obstacles, e.g., water hazards, streams, rivers, small valleys, logs across the road, etc. It is an object of the present invention to provide a toy vehicle with a self-contained bridge capable of selectively spanning a road hazard which is encountered by the toy vehicle. This road hazard spanning bridge is permanently carried by the toy vehicle and is selectively placed into the road hazard spanning position to enable the toy vehicle to pass over the road hazard. It is also a specific object of the present invention to provide an attached bridge to a toy vehicle that, after being traversed by the toy vehicle, is automatically placed into the transport mode, such that the vehicle and bridge can be moved by the child to a second location for use. It is also an object of the present invention to provide a transportable bridge, for spanning across a hazard, which bridge actually allows its own transport vehicle to pass over the hazard.

DESCRIPTION OF THE PRIOR ART

Toy vehicles which are played with by children are well-known in the art. Army type toy vehicles, including tanks and jeeps are also well-known in the art. In the army type vehicles, for example, the tanks are capable of going over or through road hazards, for example, over logs, across roads, up and over rough terrain, through water, etc. In addition, remote controlled toy vehicles including army type vehicles have been used for quite some time. These remote controlled toy vehicles are capable of being controlled, both with respect to the speed of the toy vehicle and the steering direction of the toy vehicle.

Toy bridges for toy vehicles are also well-known in the art. However, by and large these toy bridges are completely separate from the toy vehicle and are necessarily manipulated by the child using the toy bridge and toy vehicle. That is to say, the toy bridges of the prior art are manually placed in the desired position, spanning the road hazard when and where desired. It is an object of the present invention to provide a toy bridge which is fully transportable, is put into position by the vehicle and, therefore, is independent of child manipulation of the toy bridge. The present invention provides a self-contained toy bridge which is carried by the toy vehicle to locations where the bridge is required for spanning a hazard. The bridge is placed into position by the vehicle and the vehicle can then actually use the bridge. After use, the motion of the vehicle with respect to the bridge results in the bridge being automatically located in the bridge and vehicle transport mode.

Toy vehicles are also in existence which physically carry a bridge to a road hazard site for use at the desired location. These types of vehicles, however, do not have the bridge affixed to the toy vehicle for use by that toy vehicle but, rather, are intended to merely transport the bridge and then other toy vehicles, including, possibly, the transporting toy vehicle can use the bridge for surmounting the hazard. These toy vehicles, however, suffer from the disadvantage in that it is necessary to disconnect and reconnect the toy bridge to the toy vehicle for transportation and deployment of the bridge. The present invention, on the other hand, provides a self-contained bridge for a toy vehicle, such that the bridge is constantly transported by the toy vehicle to any site location. Once placed in position the bridge is capable and intended to be used by the actual transporting toy vehicle. This, then, provides an extremely exciting toy for use by a small child. The bridge, after being used by the toy vehicle, is still attached to the toy vehicle and when automatically placed in the transport mode the bridge and vehicle are again moved together, as a unit.

SUMMARY OF THE INVENTION

According to the present invention, a toy vehicle is provided with a self-contained bridge for use by the transport vehicle, itself. Preferably, the toy is remote controlled with respect to speed of the vehicle and direction. Thus, a small child, by remote control, can control the movement and location of the toy vehicle and its attached bridge. A bridge in the form of a continuously sloped up ramp and down ramp is permanently secured to the toy vehicle and capable of facilitating the toy vehicle's surmounting a hazard in the ground or road. Thus, the toy vehicle transports the bridge to the desired location, and then upon activation of a remote controlled motor, the bridge is moved from the inoperative or vehicle trailing position (the transport mode of vehicle and bridge) to an operative position with the bridge in front of the toy vehicle (the hazard spanning mode of bridge). The toy vehicle can literally pass over its own self-contained bridge and thereby surmount the road hazard. The motion or movement of the toy vehicle up and over its own self-contained bridge causes the bridge to automatically change from the operative position for the bridge, facilitating the movement of the vehicle over the road hazard, back to the vehicle trailing or transporting mode of the toy vehicle and bridge, i.e., with the bridge located behind the toy vehicle. Thus, a toy vehicle carrying its own hazard spanning bridge is provided. The entire motion and operation of the vehicle can be accomplished without the hand manipulation of the child except for the remote control. This provides a realistic play effect for children.

According to the preferred embodiment of the invention, the bridge is connected to the toy vehicle by a pair of telescopic support rods extending between the balance point of the bridge and a pair of bearings extending upwardly from the top of the sides of the toy vehicle. Suitable motors and gearing are provided to automatically cause, selectively, the bridge to change from the rear bridge transporting mode where the bridge is located behind the toy vehicle to the bridge operative position, the hazard spanning position, with the bridge located in front of the vehicle. More specifically, when the toy vehicle with the self-contained bridge attached thereto is driven to a road hazard and it is desired to utilize the bridge for transportation of the toy vehicle up and over the hazard, the remote controls controlling the speed and direction of the toy vehicle are deenergized. Then, by remote control, according to the preferred embodiment, a motor located in the toy vehicle causes the telescopic support rods extending rearwardly with respect to the toy vehicle and supporting, pivotally, the bridge to move the bridge from a rear trailing position over the top of the toy vehicle to a front position, an operative position for the bridge, such that the legs of the bridge physically span the hazard sought to be surmounted. Once the bridge is located in front of the toy vehicle in its operative position, the remote controls for the toy vehicle are again energized and the forward motion of the toy vehicle up and over the bridge causes the telescopic support rods extending between the toy vehicle and the bridge to first decrease in apparent length and then, as the toy vehicle goes down the down slope of the toy bridge to apparently increase in length, to a position where the bridge is located, once again, behind the toy vehicle. This, then, places the toy vehicle with the self-contained, attached bridge in a bridge and vehicle transport mode and allows the toy vehicle to be driven to another site for use.

DETAILED DESCRIPTION OF THE INVENTION

Figure 1:
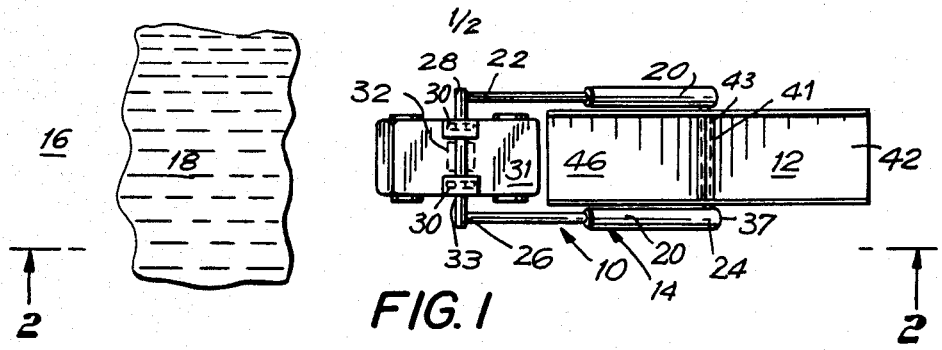
FIG. 1 is a top plan view of the present invention and a water hazard.

A toy vehicle generally referred to as 10 has a self-contained bridge 12 connected to the toy vehicle by a bridge connection mechanism 14. As best seen in the drawing figures, the toy vehicle 10 is adapted to travel on the ground 16 and the bridge 12 is intended to facilitate the movement of the toy vehicle 10 over a hazard, in the preferred embodiment, a water hazard 18, located in the path of the toy vehicle and in the ground 16. In the preferred embodiment of the present invention, both the forward speed and steering direction of the toy vehicle 10 are controlled by remote control, in a well-known manner.

Attached to the toy vehicle 10, as mentioned, is a bridge connection mechanism 14 which, in the preferred embodiment, comprises a pair of telescopic supporting tubes 20 which include a small diameter front rod 22 and a larger diameter rear rod 24. The small diameter tubes 22 slide into and out of the cylindrical housings provided by the rear larger diameter tubes 24. The forward ends 26 of the smaller diameter tubes 22 are non-rotatably secured to a shaft 28 which passes through a pair of bearings or housings 33 located on the top surface 31 of the toy vehicle 10. Shaft 28 is provided with a pair of gears 30 non-rotatably secured to shaft 28 and located in housings 33, such that rotation of gears 30 will cause the shaft 28 to rotate which, in turn, will cause the front small diameter tube 22 to rotate about the fixed horizontal axis defined by shaft 28 which, in turn, carries the rear larger diameter tubes 24 to also rotate about fixed horizontal axis defined by shaft 28. A remote controlled motor 32 is provided in the vehicle 10 and has an output shaft 35 extending from both ends of the motor 32. Each end of the output shaft 35 has a gear 34 non-rotatably attached. Gears 34 meshingly engage with gears 30. Selective activation of remote controlled motor 32 causes output shafts 35 to rotate, causing gears 34 to rotate, causing gears 30 to rotate, causing shaft 28 to rotate, causing rotation about horizontal axis defined by shaft 28, of the telescopic support tubes 20.

Figure 3:
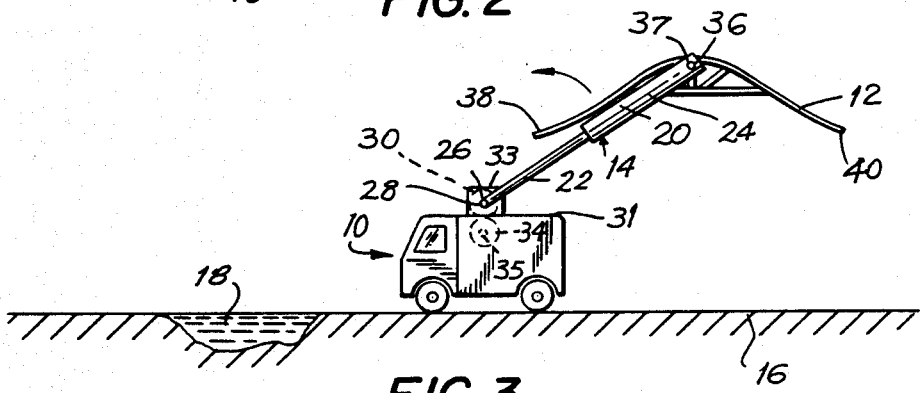
FIG. 3 is a side elevational view substantially the same view of FIG. 2 and showing the present invention as the self-contained bridge is caused to rotate from its bridge-inoperative position to its bridge-operative position, spanning the water hazard.
Figure 4:
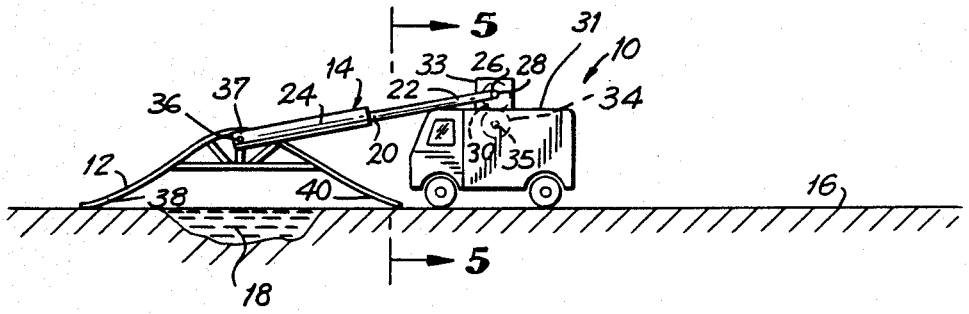
FIG. 4 is a side elevational view showing the present invention with the self-contained bridge spanning the water hazard, after the bridge has been caused to rotate from its bridge-inoperative position to its bridge-operative position.
Figure 5:
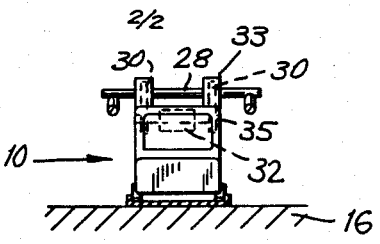
FIG. 5 is a cross sectional view taken along lines 5—5 of FIG. 4.

The distal ends 37 of the large diameter tubes 24 are rotatably secured to a balance point 36 of the bridge 12. A pivot rod 43 extends between the distal ends 37 of the large diameter tubes 24 and passes through bearings 49 (not shown) of the bridge. In this manner, the bridge 12 will always have its legs 38 and 40 projecting towards the ground (see FIG. 3) since the center of balance of the bridge is located at balance point 36. The bridge 12, in the preferred embodiment, is a continuous smooth surface and has an upwardly extending ramp portion 42, a crest portion 41 located above the balance point 36 and a downwardly directed ramp portion 46. It will be appreciated that the span of the bridge 12 is sufficient to extend ramp portions 42 and 46 beyond the water hazard 18 when the bridge 12 is placed in its operative position across the water hazard. It should also be appreciated that the length of the telescopic support tubes 20, when fully extended, is sufficient so that the bridge 12, in its inoperative or vehicle trailing position, will not contact the vehicle 10 and, yet, when the bridge is swung over the top of the toy vehicle 12, in a manner to be described, the bridge will be placed in front of the toy vehicle, also in an initial non-vehicle contacting position. It is desirable that the rear corner 51 of the toy vehicle be provided with an upwardly projecting bumper element so that the bridge, when in its rear vehicle trailing, i.e., inoperative position, will not be dragged or rest on the ground but, rather, will be suspended above the ground by the abutment of the small diameter tubes 22 of telescopic support tubes 20 with the rear bumper elements. The drawings do not show the bumper elements.

Figure 2:
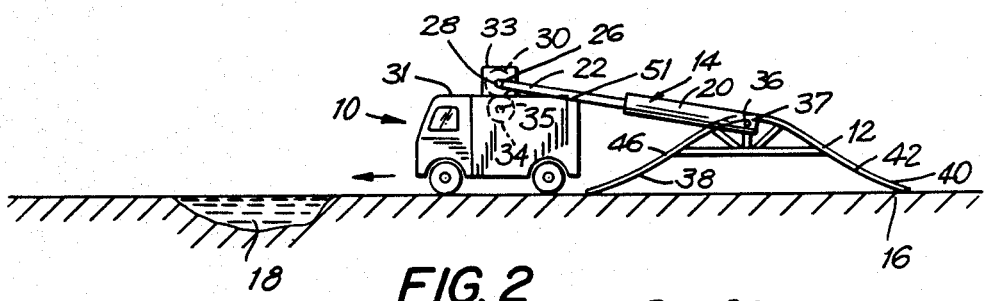
FIG. 2 is a cross sectional view taken along lines 2—2 of FIG. 1 and shows the orientation of the present invention before it reaches the water hazard.
Figure 6:
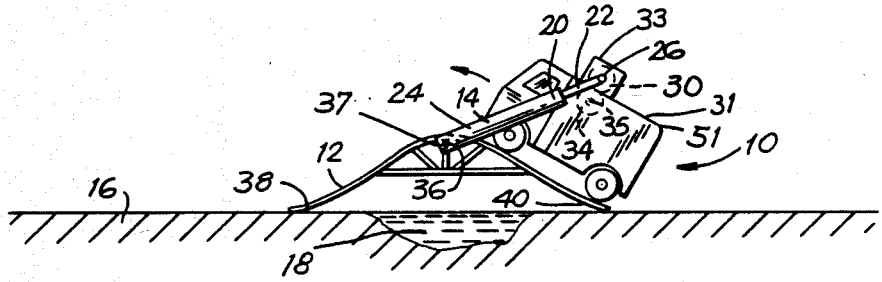
FIG. 6 is a side elevational view of the present invention and shows the vehicle as it climbs up the bridge, spanning the water hazard.
Figure 7:
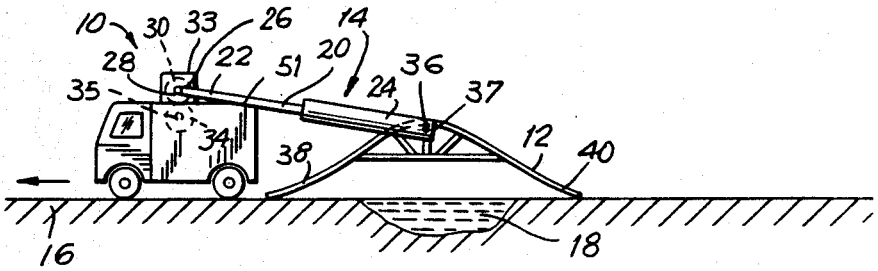
FIG. 7 is a side elevational view showing the vehicle after it has passed up and over the bridge, spanning the water hazard and with the self-contained bridge back in its bridge-inoperative position, trailing the vehicle.

In operation, the toy vehicle is controlled by remote control with regard to speed and steering direction in a well-known manner. When the child or user causes the vehicle to approach a hazard in the road, either a ditch, a stream of water or another hazard, the vehicle's forward speed is shut off. Next, preferably by remote control, motor 32 is energized which causes gears 34 to drivingly rotate gears 30 which, as mentioned, is non-rotatably secured to shaft 28. This, then, causes telescopic support tubes 20 to rotate about the horizontal axis defined by shaft 28 which results in a rotation of bridge 12 from a first rear trailing position over the top of the toy vehicle 10 to a position such that the bridge 12 is in front of the vehicle and spans the presented hazard. This movement of the bridge from a first rear trailing inoperative position to a second forward operative position is fully shown in FIGS. 1–3. Once the bridge is in the forward operative position, motor 32 is shut off. Then, by remote control, the forward driving motion of the toy vehicle is reenergized and this time, however, the toy vehicle will drive up the up-ramp 42 of the bridge, as best shown in FIG. 6. The friction between the legs of the bridge and the ground maintains the bridge in position while the vehicle travels to the upward ramp of the bridge. Then the weight of the vehicle maintains the bridge in position as the vehicle travels over it. As the toy vehicle 10 drives up the up-ramp 42, it will be appreciated that the apparent length of the telescopic support tubes 20 will incrementally decrease, i.e., the small diameter tubes 20 will slide within the larger diameter tubes 24. As soon as the toy vehicle 10 reaches the crest of the bridge 12, the vehicle is still caused to move in its forward direction by the remote controlled motor of the toy vehicle. Now, however, the apparent length of the telescopic support tubes 20 will increase in length as the toy vehicle moves from the crest of the bridge, along down ramp 46 and back onto the ground 16. Once the toy vehicle reaches the ground 16, it will be apparent that the bridge 12 is, once again, located behind the toy vehicle in its original trailing position, i.e., in its inoperative position. Now, again, the toy vehicle 10 can be driven, as desired, by remote control to another water hazard or road hazard.

In this manner, it will be appreciated that the present invention provides a toy vehicle which is movable by remote control and which carries its own self-contained bridge for spanning road hazards. When the vehicle approaches a hazard, it is stopped, the bridge is caused to rotate about the axis defined by shaft 28 and the bridge is moved from its first inoperative position, over the top of the toy vehicle, the legs 38 and 40 of the bridge always extending toward the ground by the balancing of the bridge about balance point 36 and the bridge is then placed on the ground in a hazard-spanning position. Then, the toy vehicle is driven over its own self-contained bridge. Once the toy vehicle has driven over the self-contained bridge, the motion of the toy vehicle up and over the bridge causes the bridge to automatically move from the operative, forward position back to its original vehicle trailing and bridge inoperative position. This, then, allows the toy vehicle to be driven to its next road hazard.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A vehicle with self-contained bridge comprising:

(a) a movable vehicle capable of traveling on a surface;

(b) a hazard spanning bridge secured to said vehicle by bridge connection means;

(c) said bridge having both a bridge operative position wherein said bridge is in front of the intended direction of movement of said vehicle and said bridge is supported directly on said surface, and a bridge and vehicle transport position wherein said bridge is behind the intended direction of movement of said vehicle and said bridge is suspended and held above said surface by said bridge connection means;

(d) said bridge, when in its bridge operative position, allowing said vehicle to pass thereover; and (e) the passage of said vehicle over said bridge causes said bridge to change from said bridge operative position to said bridge and vehicle transport position.

2. A vehicle as claimed in claim 1, wherein said bridge connection means comprises a pair of telescopic support tubes connected between said vehicle and said bridge.

3. A vehicle as claimed in claim 2 wherein said bridge is continuous and has a smooth ramp-up connected by a bridge crest portion to a smooth ramp down.

4. A vehicle as claimed in claim 3 wherein the apparent length of said telescopic support tubes first decreases as said vehicle travels from said surface to the crest of said bridge and then increases in apparent length back to their original length, as said vehicle travels from said crest of said bridge back to said surface.

5. A vehicle as claimed in claim 1, further comprising selectively actuated bridge position changing means for selectively changing said bridge from said bridge and vehicle transport position to said bridge operative position.

6. A toy vehicle having a self-contained bridge comprising:

(a) a movable vehicle capable of traveling and stopping on a surface;

(b) a hazard spanning bridge secured to said vehicle by bridge connection means;

(c) said bridge connection means comprising a pair of telescopic support tubes, the first ends of which are secured to said vehicle and the second ends of which are secured about the mid point of said bridge;

(d) said bridge having a transport position whereby said bridge is located behind said vehicle as said vehicle travels in a forward direction on said surface and whereby said bridge is suspended above said surface by said bridge connection means and is moved along with said vehicle and a hazard spanning position whereby said bridge is positioned on said surface and in front of said vehicle with respect to the stopped forward direction of movement of said vehicle; and (e) said vehicle can travel over said bridge when it is in its hazard spanning position which thereby causing said bridge to change from said hazard spanning position to said transport position.

7. A toy vehicle as claimed in claim 6, wherein said bridge is pivotally balanced on said telescopic support tubes.

8. A toy vehicle as claimed in claim 6, further comprising bridge position changing means for selectively causing said bridge to change from said transport position to said hazard spanning position.

9. A toy vehicle as claimed in claim 8, wherein said bridge position changing means is a motor and a gear arrangement connected to said first ends of 10. A toy vehicle as claimed in claim 6, wherein the apparent length of said telescopic support tubes is minimized when said vehicle passes over the midpoint of said bridge.

11. A toy vehicle as claimed in claim 6 wherein:

(a) said bridge comprises two continuous sections, a first section going up to a crest and a second section coming down from said crest; and (b) the apparent length of said telescopic support tubes decreases from its initial length as said vehicle moves across said first section and increases back to its initial length as said vehicle moves across said second section.

* * * * *